US006048826A

United States Patent [19]

Ikeda et al.

[11] Patent Number: 6,048,826

[45] Date of Patent: Apr. 11, 2000

[54] LUBRICATING OIL COMPOSITION

[75] Inventors: Toshiki Ikeda; Toshihiko Ichihashi; Hiroshi Shirosawa, all of Ichihara, Japan

[73] Assignee: Idemitsu Kosan Co., Ltd., Tokyo, Japan

[21] Appl. No.: 09/084,306

[22] Filed: May 26, 1998

[30] Foreign Application Priority Data

Jun. 4, 1997 [JP] Japan ..... 9-146445

[51] Int. Cl.[7] ..... C10M 141/08

[52] U.S. Cl. ..... 508/364

[58] Field of Search ..... 508/364, 527, 508/551, 554

[56] References Cited

U.S. PATENT DOCUMENTS

| | | | |
|---|---|---|---|
| 2,856,363 | 10/1958 | Beennan | 508/364 |
| 3,707,498 | 12/1972 | Milsom | 508/364 |
| 4,537,694 | 8/1985 | Horodysky | 508/527 |
| 4,648,985 | 3/1987 | Thorsell et al. | 508/364 |
| 4,786,423 | 11/1988 | Schroeder | 508/364 |
| 4,849,119 | 7/1989 | Horodysky | 508/527 |
| 4,992,186 | 2/1991 | Habeeb et al. | 508/364 |
| 5,356,547 | 10/1994 | Arai et al. | 508/364 |
| 5,627,146 | 5/1997 | Tanaka et al. | 508/364 |
| 5,763,370 | 6/1998 | Doner et al. | 508/364 |

FOREIGN PATENT DOCUMENTS

| | | |
|---|---|---|
| 0 609 623 | 8/1994 | European Pat. Off. . |
| 90/04625 | 5/1990 | WIPO . |
| 95/15368 | 6/1995 | WIPO . |

*Primary Examiner*—Jerry D. Johnson

*Attorney, Agent, or Firm*—Oblon, Spivak, McClelland, Maier & Neustadt, P.C.

[57] ABSTRACT

Disclosed is a lubricating oil composition, which comprises a base oil and additives of (A) a dithiocarbamate compound and (B) a condensate of a branched chain fatty acid having from 8 to 30 carbon atoms and an amine, and optionally (C) an amine-type antioxidant. The composition has an excellent shudder-preventing ability and has a long shudder-preventing life.

7 Claims, No Drawings

LUBRICATING OIL COMPOSITION

FIELD OF THE INVENTION

The present invention relates to a lubricating oil composition, and, more precisely, to that favorable to lubricating oil for automatic and continuously variable transmissions equipped with a wet clutch, and also to shock absorber oil, power steering oil, hydraulic fluid and the like for slide members composed of an organic material and an inorganic material.

BACKGROUND OF THE INVENTION

Wet clutches are used in lock-up devices and multi-stage transmission devices to be built in torque converters for conventional automatic transmissions, and some types of such wet clutches are being now applied to not only automatic transmissions but also continuously variable transmissions.

However, when locked up, wet clutches often vibrate or give a shock, thereby often giving an unpleasant feeling to drivers. Continuous vibration and shock is referred to as "shudder", which gives a great unpleasant feeling to drivers and often makes it difficult to continue safe driving. It is known that the friction characteristic of lubricating oil existing in clutches is a critical factor relating to the shudder (see PETROTEC 19, (3), 233 (1966), etc.). In this connection, it is said that lubricating oil for clutches is preferably characterized by the increase in its friction coefficient with the increase in its sliding velocity. However, if the preferred friction characteristic of lubricating oil could last only within a short period of time, the lubricating oil being used must be frequently exchanged for a fresh one. If so, therefore, transmissions using such lubricating oil could not well exhibit their intrinsic characteristics.

For the reasons mentioned above, strongly desired is a lubricating oil composition capable of keeping its good friction characteristic for a long period of time, or that is, a lubricating oil composition having a long shudder-preventing life.

SUMMARY OF THE INVENTION

Based on the viewpoint noted above, the present invention has been made, and its object is to provide a lubricating oil composition having an excellent shudder-preventing ability and having along shudder-preventing life.

We, the present inventors have assiduously studied and, as a result, have found that the object of the invention can be effectively attained by adding to base oil additives of a dithiocarbamate compound and a condensate of a particular fatty acid and an amine. On the basis of this finding, we have completed the present invention.

Specifically, the invention provides a lubricating oil composition comprising a base oil and additives of (A) dithiocarbamate compound and (B) a condensate of a branched chain fatty acid having from 8 to 30 carbon atoms and an amine, and optionally (C) an amine-type antioxidant.

MODES OF CARRYING OUT THE INVENTION

Now, the modes of carrying out the invention are described hereinunder.

The lubricating oil composition of the invention comprises a mineral oil and/or a synthetic oil as the base oil. The mineral oil and the synthetic oil are not specifically defined, but may be any ordinary ones that are generally used as the base oil of ordinary lubricating oil. However, preferred are those having a dynamic viscosity at 100° C. of from 1 to 50 $mm^2/s$, more preferably from 2 to 15 $mm^2/s$. If the base oil has a too high dynamic viscosity, its low-temperature viscosity is unfavorably low; but, on the contrary, if its dynamic viscosity is too low, such is also unfavorable since the base oil having such a too low dynamic viscosity causes the increase in the friction in the slide members such as gear bearings and clutches of automatic transmissions. The percentage $C_A$ of the base oil is preferably not larger than 20, more preferably not larger than 10, in view of its antioxidation stability. The pour point of the base oil, which is the index for its low-temperature fluidity, is not specifically defined, but is desirably not higher than −10° C., more desirably not higher than −15° C.

Various types of such mineral oil and synthetic oil are known, and any desirable ones may be selectively used in accordance with the object. The mineral oil includes, for example, paraffinic mineral oils, naphthenic mineral oils and intermediate mineral oils. As specific examples, referred to are light neutral oils, medium-gravity neutral oils, heavy neutral oils and bright stocks to be prepared through solvent purification or hydrogenating purification. Of those, preferred are light or medium-gravity neutral oils of paraffinic mineral oils.

On the other hand, the synthetic oil includes, for example, poly-olefins, -olefin copolymers, polybutenes, alkylbenzenes, polyol esters, dibasic acid esters, polyoxyalkylene glycols, polyoxyalkylene glycol esters, polyoxyalkylene glycol ethers, hindered esters, and silicone oils. Of those, preferred are poly-olefins and polyol esters.

These base oils can be used singly or as combined. Combinations of mineral oils and synthetic oils are also employable.

In the invention, the base oil is preferably combined with a viscosity index improver. For example, the base oil may be combined with preferably up to 30% by weight, more preferably from 0.1 to 25% by weight, even more preferably from 0.5 to 20% by weight, relative to the total weight of the composition, of a viscosity index improver. As the viscosity index improver for use herein, preferred are olefinic (co) polymers such as ethylene-propylene copolymers, and also polymethacrylates and polyisobutylenes. In view of their low-temperature characteristics, especially preferred are polymethacrylates. Polymethacrylates for use herein preferably have a number-average molecular weight of from 10,000 to 1,000,000, more preferably from 10,000 to 100,000, even more preferably from 10,000 to 70,000, in view of their shear stability. Preferably, the base oil combined with any of the viscosity index improvers mentioned above has a viscosity index (VI) of not lower than 130, more preferably not lower than 160, in view of the low-temperature starting properties of the lubricating oil composition comprising them.

Now, the additives (A) to (C) to the base oil are referred to hereinunder.

Component (A)

The dithiocarbamate compound of the component (A) that constitutes the lubricating oil composition of the invention may be any known one, including, for example, metal dithiocarbamates (e.g., molybdenum, tungsten, zinc, copper, nickel, iron, cadmium, silver, lead, antimony, tin and bismuth dithiocarbamates), and compounds of two molecules of dithiocarbamic acid as bonded together via an alkylene group such as methylene. Dithiocarbamate compounds are known as abrasion inhibitors and antioxidants. In the composition of the invention, however, the dithiocarbamate compound acts as an agent for retaining the friction characteristic of the composition.

The component (A) may be composed of one or more dithiocarbamate compounds either singly or as combined.

The amount of the component (A) in the composition is preferably from 0.05 to 1% by weight, more preferably from 0.1 to 0.8% by weight, relative to the total weight of the composition. If its amount is smaller than 0.05% by weight, the component (A) could hardly exhibit its ability to retain the friction characteristic of the composition. On the other hand, if the amount of the component (A) is larger than 1% by weight, the antioxidation stability of the composition will be poor.

Component (B)

The component (B) constituting the lubricating oil composition of the invention is a condensate of a branched chain fatty acid having from 8 to 30 carbon atoms and an amine.

The branched chain fatty acid having from 8 to 30 carbon atoms may be either saturated or unsaturated, and includes, for example, isolauric acid, isomyristic acid, isostearic acid, isoarachic acid, isobehenic acid, isolindelic acid, isomyristoleic acid, isosomalic acid, isooleic acid, and isoerucic acid.

On the other hand, the amine to be reacted the fatty acid includes, for example, polyalkylene-polyamines such as diethylenetriamine, triethylenetetramine, tetraethylenepentamine, pentaethylenehexamine, hexaethyleneheptamine, heptaethyleneoctamine, dipropylenetriamine, tetrapropylenepentamine, and hexabutyleneheptamine; and alkanolamines such as monoethanolamine and diethanolamine.

Of these, preferred are a combination of isostearic acid and tetraethylenepentamine, and a combination of isooleic acid and diethanolamine.

The component (B) may be composed of one or more such fatty acids either singly or as combined.

The amount of the component (B) in the composition is preferably from 0.05 to 2% by weight, more preferably from 0.2 to 1% by weight, relative to the total weight of the composition. If its amount is smaller than 0.05% by weight, the component (B) will poorly exhibit its ability to improve the friction characteristic of the composition. On the other hand, if the amount of the component (B) is larger than 2% by weight, the friction factor of the composition will be lowered too much thereby causing transmission trouble.

The object of the invention is attained by adding the components (A) and (B) to a base oil. Preferably, however, an amine-type antioxidant of the component (C) is further added to the composition comprising the components (A) and (B) and a base oil, whereby the shudder-preventing life of the composition is further improved. Accordingly, the composition comprising the components (A), (B) and (C) and a base oil is one preferred embodiment of the invention.

Component (C)

The amine-type antioxidant includes, for example, monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine and 4,4'-octyl-tert-butyldiphenylamine; polyalkyldiphenylamines such as tetrabutyldiphenylamine, tetrahexyldiphenylamine, tetraoctyldiphenylamine and tetranonyldiphenylamine; and naphthylamines such as -naphthylamine, phenyl-naphthylamine, butylphenyl-naphthylamine, pentylphenyl-naphthylamine, hexylphenyl-naphthylamine, heptylphenyl-naphthylamine, octylphenyl-naphthylamine and nonylphenyl-naphthylamine. Of these, preferred are dialkyldiphenylamines and naphthylamines.

The component (C) may be composed of one or more such amine-type antioxidants either singly or as combined.

The amount of the component (C) in the composition is preferably up to 2% by weight, more preferably from 0.05 to 2% by weight, even more preferably from 0.2 to 1% by weight, relative to the total weight of the composition. If its amount is smaller than 0.05% by weight, the component (C) will poorly exhibit its ability to prevent the composition from being oxidized. On the other hand, even if the component (C) is in the composition in an amount of larger than 2% by weight, its effect will be no more enhanced.

The lubricating oil composition of the invention can be obtained by adding the components (A) and (B) and optionally the component (C) to a base oil. If desired, the composition may additionally contain any known additives such as antioxidant (except amine-type antioxidants), detergent dispersant, metal inactivator and defoaming agent in order to have further improved properties. The amount of these additives in the composition is preferably from 0.05 to 15% by weight relative to the total weight of the composition.

Now, the present invention is described in more detail hereinunder with reference to the following examples, which, however, are not intended to restrict the scope of the invention.

The samples prepared in Examples and Comparative Examples were tested for their properties, according to the methods mentioned below.

(1) Shudder-preventing Ability:

A ratio of $\mu l/\mu 50$ was obtained, according to the method of testing properties of automatic transmission fluids (JASO M349-95), to evaluate the shudder-preventing ability of samples.

Test Condition:

Oil temperature: 40° C.

Surface pressure: 1.00±0.05 MPa $\mu l$: coefficient of friction at a sliding velocity of 0.006 m/sec.

$\mu 50$: coefficient of friction at a sliding velocity of 0.030 m/sec.

(2) Shudder-preventing Life:

A sample oil was aged according to JIS K2514 (test for antioxidation stability of lubricating oil for internal-combustion engines), whereupon the friction characteristic of the aged sample was measured at predetermined intervals for a predetermined period of time according to JASO M349-95. The time within which the $\mu$ ratio of the sample reached larger than 1.0 was measured to be the life time of the sample. Examples 1 to 5, and Comparative Examples 1 to 7:

As in Table 1 below, additive components were added to a base oil to prepare various lubricating oil compositions of Examples and Comparative Examples. These samples were tested for their properties according to the methods mentioned above. The data obtained are shown in Table 1.

TABLE 1-1

| | | | Example 1 | Example 2 | Example 3 | Example 4 | Example 5 |
|---|---|---|---|---|---|---|---|
| Compositional Ratio wt. % | Base Oil(*1) | | balance | balance | balance | balance | balance |
| | Polymethacryate(*2) | | 10.0 | 10.0 | 10.0 | 10.0 | 10.0 |
| | Component (A) | Zinc Dithiocarbamate | 0.5 | — | — | 0.5 | 0.5 |
| | | Molybdenum Dithiocarbamate | — | 0.4 | — | — | — |
| | | Methylene Dithiocarbamate | — | — | 0.5 | — | — |
| | | Tricresyl Phosphate | — | — | — | — | — |
| | Component (B) | Condensate of Fatty Acid and Amine(*3) | 0.7 | 0.7 | 0.7 | 0.7 | 0.7 |
| | | Glyceride(*4) | — | — | — | — | — |
| | Component (C) | Phenyl-α-naphthylamine | — | — | — | 0.5 | — |
| | | Diphenylamine(*5) | — | — | — | — | 0.5 |
| | Other Additives(*6) | | 1.8 | 1.8 | 1.8 | 1.8 | 1.8 |
| Ratio $\mu$ of Fresh Sample | | | 0.85 | 0.87 | 0.86 | 0.85 | 0.84 |
| Time before the ratio $\mu$ of sample reached larger than 1.0 (hr) | | | 216 | 192 | 216 | 288 | 288 |

TABLE 1-2

| | | | Comp. Example 1 | Comp. Example 2 | Comp. Example 3 | Comp. Example 4 | Comp. Example 5 | Comp. Example 6 | Comp. Example 7 |
|---|---|---|---|---|---|---|---|---|---|
| Compositional Ratio wt. % | Base Oil(*1) | | balance | balance | balance | balance | balance | balance | balance |
| | Polymethacrylate(*2) | | 10.0 | 10.0 | 10.0 | 10.0 | 10.0 | 10.0 | 10.0 |
| | Component (A) | Zinc Dithiocarbamate | 0.5 | — | — | 0.5 | — | 0.5 | — |
| | | Molybdenum Dithiocarbamate | — | — | — | — | — | — | — |
| | | Methylene Dithiocarbamate | — | — | — | — | — | — | — |
| | | Tricresyl Phosphate | — | — | — | — | — | — | 0.3 |
| | Component (B) | Condensate of Fatty Acid and Amine(*3) | — | 0.7 | — | — | 0.7 | — | 0.7 |
| | | Glyceride(*4) | — | — | — | — | — | 0.5 | — |
| | Component (C) | Phenyl-α-naphthylamine | — | — | 0.5 | 0.5 | 0.5 | — | 0.5 |
| | | Diphenylamine(*5) | — | — | — | — | — | — | — |
| | Other Additives(*6) | | 1.8 | 1.8 | 1.8 | 1.8 | 1.8 | 1.8 | 1.8 |
| Ratio $\mu$ of Fresh Sample | | | 1.04 | 0.82 | 1.02 | 1.05 | 0.84 | 0.85 | 0.86 |
| Time before the ratio $\mu$ of sample reached larger than 1.0 (hr) | | | 0 | 48 | 0 | 0 | 96 | 24 | 48 |

*1: Paraffinic mineral oil having a dynamic viscosity of 4.3 $mm^2$/sec (100° C.), a % $C_A$ of 0 (zero) and a pour point of −20° C.
*2: This had a number-average molecular weight of 50,000.
*3: Condensate of isostearic acid and tetraethylenepentamine.
*4: Oleic acid monoglyceride.
*5: 4,4'-Octyl-tert-butyldiphenylamine.
*6: Antioxidant (except amines), detergent dispersant, defoaming agent.

The data of Examples and Comparative Examples shown in Table 1 verify the following:

① The samples of Examples have a ratio m falling between 0.84 and 0.87, which is below 1, and their shudder-preventing ability is good.

② In the predetermined test, the samples of Examples were found to have a shudder-preventing life of 192 hours or longer, which was longer than that of the sample of Comparative Example 2 by 2 times or more. In practical use in automobiles, the samples of Examples could have a satisfactorily long shudder-preventing life.

③ The ratio $\mu$ of the fresh sample of Comparative Example 1, which does not have the component (B), is larger than 1, when compared with that of the fresh sample of Example 1. Therefore, the shudder-preventing ability of the sample of Comparative Example 1 is poor.

④ The fresh sample of Comparative Example 2, which does not have the component (A), was good, as having a ratio $\mu$ of 0.82. However, the life of the sample of Comparative Example 2 was short, and was ¼ of the life of the sample of Example 1.

⑤ The ratio $\mu$ of the fresh sample of Comparative Example 3, which does not have the components (A) and (B), is larger than 1, when compared with that of the fresh sample of Example 4. Therefore, the shudder-preventing ability of the sample of Comparative Example 3 is poor.

⑥ The ratio $\mu$ of the fresh sample of Comparative Example 4, which does not have the component and (B), is larger than 1, when compared with that of the fresh sample of Example 4. Therefore, the shudder-preventing ability of the sample of Comparative Example 4 is poor.

⑦ The fresh sample of Comparative Example 5, which does not have the component (A), was good, as having a ratio $\mu$ of 0.84. However, the life of the sample of Comparative Example 5 was short, and was ⅓ of the life of the sample of Example 4.

⑧ The fresh sample of Comparative Example 6, which contains a glyceride in place of the component (B), was good, as having a ratio of 0.85. However, its life is very short.

⑨ The fresh sample of Comparative Example 7, which contains tricresyl phosphate in place of the component (A), was good, as having a ratio $\mu$ of 0.85. However, its life is very short.

As having been mentioned in detail hereinabove, the lubricating oil composition of the invention has an excellent shudder-preventing ability, and its good ability lasts long.

While the invention has been described in detail and with reference to specific embodiments thereof, it will be apparent to one skilled in the art that various changes and modifications can be made therein without departing from the spirit and scope thereof.

What is claimed is:

1. A lubricating oil composition, which comprises a base oil containing a viscosity index improver, and additives of (A) from 0.05 to 1% by weight, relative to the total weight of the composition, of a dithiocarbamate compound and (B) from 0.05 to 2% by weight, relative to the total weight of the composition, of a condensate of a branched chain fatty acid having from 8 to 30 carbon atoms and an amine selected from the group consisting of diethylenetriamine, triethylenetetramine, tetraethylenepentamine, pentaethylenehexamine, hexaethyleneheptamine, heptaethyleneoctamine, dipropylenetriamine, tetrapropylenepentamine, hexabutyleneheptamine, monoethanolamine and diethanolamine, and wherein said base oil combined with a viscosity index improver and has a viscosity index of not lower than 160, and wherein said composition has an initial $\mu 1/\mu 50$ ratio of less than 1.0 according to JASO M349-95, wherein $\mu 1$ is the coefficient of friction at a sliding velocity of 0.006 m/sec, and $\mu 50$ is the coefficient of friction at a sliding velocity of 0.030 m/sec, and wherein upon aging said composition in accordance with JIS K2514, the time within which said ratio reaches larger than 1.0 according to said JASO M349-95 is at least 192 minutes.

2. The lubricating oil composition as claimed in claim 1, which further comprises (C) an amine antioxidant.

3. The lubricating oil composition as claimed in either claim 1 or 2, wherein the component (B) is a condensate of isostearic acid and tetraethylenepentamine.

4. The lubricating oil composition as claimed in claim 1, wherein the base oil comprises a viscosity index improver up to 30% by weight, relative to the total weight of the composition.

5. The lubricating oil composition as claimed in claim 1, which further comprises (C) from 0.05 to 2% by weight, relative to the total weight of the composition, of an amine antioxidant.

6. A method for preventing shudders, wherein a lubricating oil composition of claim 1 is applied to the wet clutches of continuously variable transmissions or automatic transmissions.

7. A method for preventing shudders, wherein a lubricating oil composition of claim 1 is applied to the slide members of shock absorbers.

* * * * *